US006368549B1

(12) United States Patent
Bendick et al.

(10) Patent No.: US 6,368,549 B1
(45) Date of Patent: Apr. 9, 2002

(54) METALLURGICAL VESSEL

(75) Inventors: Walter Bendick; Günter Schmitz; Siegfried Muller, all of Duisburg; Dieter Uwer, Essen, all of (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/485,969

(22) PCT Filed: Jul. 24, 1998

(86) PCT No.: PCT/DE98/02203

§ 371 Date: May 10, 2000

§ 102(e) Date: May 10, 2000

(87) PCT Pub. No.: WO99/09232

PCT Pub. Date: Feb. 25, 1999

(30) Foreign Application Priority Data

Aug. 19, 1997 (DE) ..... 197 36 720

(51) Int. Cl.[7] ..... C22C 38/44; C22C 38/46; C21D 8/00

(52) U.S. Cl. ..... 266/198; 148/194; 148/522; 148/529; 420/109

(58) Field of Search ..... 420/109; 148/194, 148/522, 529, 335; 266/197, 198

(56) References Cited

U.S. PATENT DOCUMENTS

| | | | | |
|---|---|---|---|---|
| 3,918,692 A | * | 11/1975 | Oberg | 266/35 |
| 3,989,231 A | * | 11/1976 | Randerson | 266/114 |
| 4,468,249 A | * | 8/1984 | Lehman | 420/109 |
| 5,525,167 A | * | 6/1996 | McVicker | 420/109 |
| 5,698,159 A | * | 12/1997 | Ochi et al. | 420/109 |
| 6,126,897 A | * | 10/2000 | Aihara et al. | 420/109 |

FOREIGN PATENT DOCUMENTS

| | | | |
|---|---|---|---|
| EP | 580062 A | * | 1/1994 |
| JP | 59-25957 A | * | 2/1984 |
| JP | 05-171343 A | * | 7/1993 |
| JP | 08-041582 A | * | 2/1996 |

OTHER PUBLICATIONS

Kawasaki, H., et al., "Design Technique for Extending Life of LD Converter Vessel", La Revue de Metallurgie, Mar. 1991, pp. 255–261.*

Musgen, B., et al., "High–strength Fine–grained steels that have been Heat Treated using Water, with Minimum Yield Points up to 90 kp/mm2", Dechma Monogr., vol. 76, 1974, pp. 151–162.*

* cited by examiner

*Primary Examiner*—George Wyszomierski
(74) *Attorney, Agent, or Firm*—Cohen, Pontani, Lieberman & Pavane

(57) ABSTRACT

Disclosed is a metallurgical vessel, in particular a converter for treating liquid molten metals, in particular steel, formed of a refractory lining and a supporting metal shell that surrounds the refractory lining. The vessel is composed of welded together shell rings and dished parts of creep-resistant steel with plate thicknesses of up to 100 mm. The creep-resistant steel used is a highly resistant, water-quenched and then tempered close-grained structural steel with the following composition in wt.-%

C 0.14–0.22
Cr 0.4–1.0
Mo 0.3–0.8
Ni 1.5–3.0
V 0.05–0.12
Mn 0.7–1.3
$P_{max}$ 0.015
$S_{max}$ 0.003
Al 0.015–0.065
Si 0.20–0.60
$Cu_{max}$ 0.15
$N_{max}$ 0.012
$Ca_{max}$ 0.004 the remainder being iron and impurities due to the production process.

10 Claims, 2 Drawing Sheets

METALLURGICAL VESSEL

BACKGROUND OF THE INVENTION

The invention concerns a metallurgical vessel, in particular a converter for treating liquid molten metals, comprising a refractory lining and a supporting metal shell that surrounds the refractory lining.

Metallurgical vessels, such as converters or steelmaking ladles for example, are subjected not only to the static loading caused by the weight of the lining and the liquid molten metal with which they are filled but also to a thermal loading caused by the high temperatures. The supporting metal shell of these vessels must therefore be fabricated from a material which has a certain creep resistance, for example for 100,000 hours with respect to a predetermined temperature. The previously used steels, for example WStE.355, are capable of withstanding a maximum temperature of around 400° C. Because of a high carbon content in the lining, accompanied by considerable burnoff of the lining toward the end of the run, the vessel shell temperatures rise.

In addition, the increasing secondary metallurgical treatment, for example vacuum treatment, which is frequently accompanied by not inconsiderable temperature losses, requires a higher melting temperature to compensate for this temperature loss. This results in greater thermal loading of the vessel, whether a converter or ladle, so that the requirement for adequate creep resistance at an elevated temperature becomes obligatory.

It is desireable that the steel be capable of withstanding a temperature of 500° C., and preferably 550° C. Creep-resistant steels which are suitable for this temperature range are known from the boiler tube sector, for example 15 Mo 3, 13 CrMo 44 or 10 CrMo 9.10. However, all these steels suffer from the great disadvantage that the component must be stress-relief annealed at a temperature of around 700° C. after welding. This operation requires large furnaces and a large energy expenditure and the corresponding required handling. In particular in cases where repairs are made to vessels, the disadvantage mentioned occurs in particular. Repairs are necessary whenever the liquid molten metal has melted and partially destroyed the vessel shell because of excessive lining burnoff.

The object of the invention is to provide a metallurgical vessel of the generic type with a supporting metal shell having an adequate creep resistance up to max. 550° C. which does not require stress-relief annealing after welding.

SUMMARY OF THE INVENTION

The above stated object is obtained by a metallurgical vessel of the invention.

The present invention is in a metallurgical vessel comprising a refractory lining having a supporting metal shell surrounding the refractory lining. The metal shell has welded shell rings and dished parts of creep-resistant steel with plate thickness of up to 100 mm. The creep-resistant steel is a highly resistant, water-quenched and then tempered close-grained structural steel having the following composition in wt.-%:

C 0.14–0.22
Cr 0.4–1.0
Mo 0.3–0.8
Ni 1.5–3.0
V 0.05–0.12
Mn 0.7–1.3

$P_{max}$ 0.015
$S_{max}$ 0.003
Al 0.015–0.065
Si 0.20–0.60
$Cu_{max}$ 0.15
$N_{max}$ 0.012
$Ca_{max}$ 0.004, with the remainder being iron and impurities due to the production process.

The vessel of the invention displays a creep-resistance of 10,000 hours at 500° C. of 220 N/mm$^2$ and 550° C. of 130 N/mm$^2$. The vessel may be a liquid molten converter for steel.

Also included is a process for producing the vessel. That process includes a) melting a killed steel by the basic oxygen process with a composition corresponding to that set forth above; b) extruding a slab from the melted killed steel; c) heating the slab; d) rolling the slab into heavy plate; e) quenching and tempering the heavy plate; f) flame-cutting the plate into parts; g) bending and/or pressing into parts; h) welding the parts into a metal shell; i) stress-relief annealing; and j) fitting of the refractory lining into the shell. Prior to casting, the steel is calcium-treated by blowing a calcium alloy into the steel bath and is subsequently vacuum-treated. The hot rolling is carried out with a number of forming passes, which have an individual dimensional change of $\epsilon_n$>0.1, in conjunction with quenching and tempering, thereby dispensing with stress-relief annealing after the welding of the parts produced from the heavy plate.

The quenching and tempering can be water-quenching from the austenitic range with subsequent tempering. The tempering temperature can be between 690 and 720° C. The quenching and tempering can be heating up twice to the austenitic temperature with respect to water-quenching and tempering. It has been found that a highly resistant, water quenched and then tempered, close-grained structural steel known per se is well suited for this intended use. This close-grained structural steel is usually used with a yield strength of at least 890 N/mm$^2$ in vehicle construction, for lifting apparatus, mining equipment and blower wheels. In these cases, the high yield strength is of particular significance so as to be able to use the lowest possible wall thicknesses and an adequate low temperature. See company brochure of Thyssen Stahl AG XAB090/XAB0960 Hochfeste vergütete Feinkornbaustähle [Highly resistant quenched and tempered close-grained structural steels (1993)].

Numerous tests with this close-grained structural steel have now shown that, by modifying the composition and by specific tempering treatment during quenching and tempering, one can obtain creep strengths which make its use for metallurgical vessels of interest. The yield strength lower than 890 N/mm$^2$ is acceptable in this instance, since it is not the decisive criterion. Nevertheless, the still high yield strength of at least 650 N/mm$^2$ still permits a certain reduction in the wall thickness, which is advantageous for the overall construction. A decisive advantage is, however, that no stress-relief annealing is required after welding. This results in a simplified production process and an energy savings. The increased nickel content of the composition permits full quenching and tempering even of plate thicknesses of up to 100 mm. Such wall thicknesses are sometimes required for the intended use. The known close-grained structural steel is usually designed for plate thicknesses of up to at most 50 mm.

The various features of novelty which characterize the invention are pointed out with particularity in the claims appended to and forming a part of this specification. For a better understanding of the invention, its operating advantages and specific objects obtained by its use, reference should be had to the accompanying drawings and descriptive matter in which there is illustrated and described a preferred embodiment of the invention.

DESCRIPTION OF PREFERRED EMBODIMENT

Figure 1:
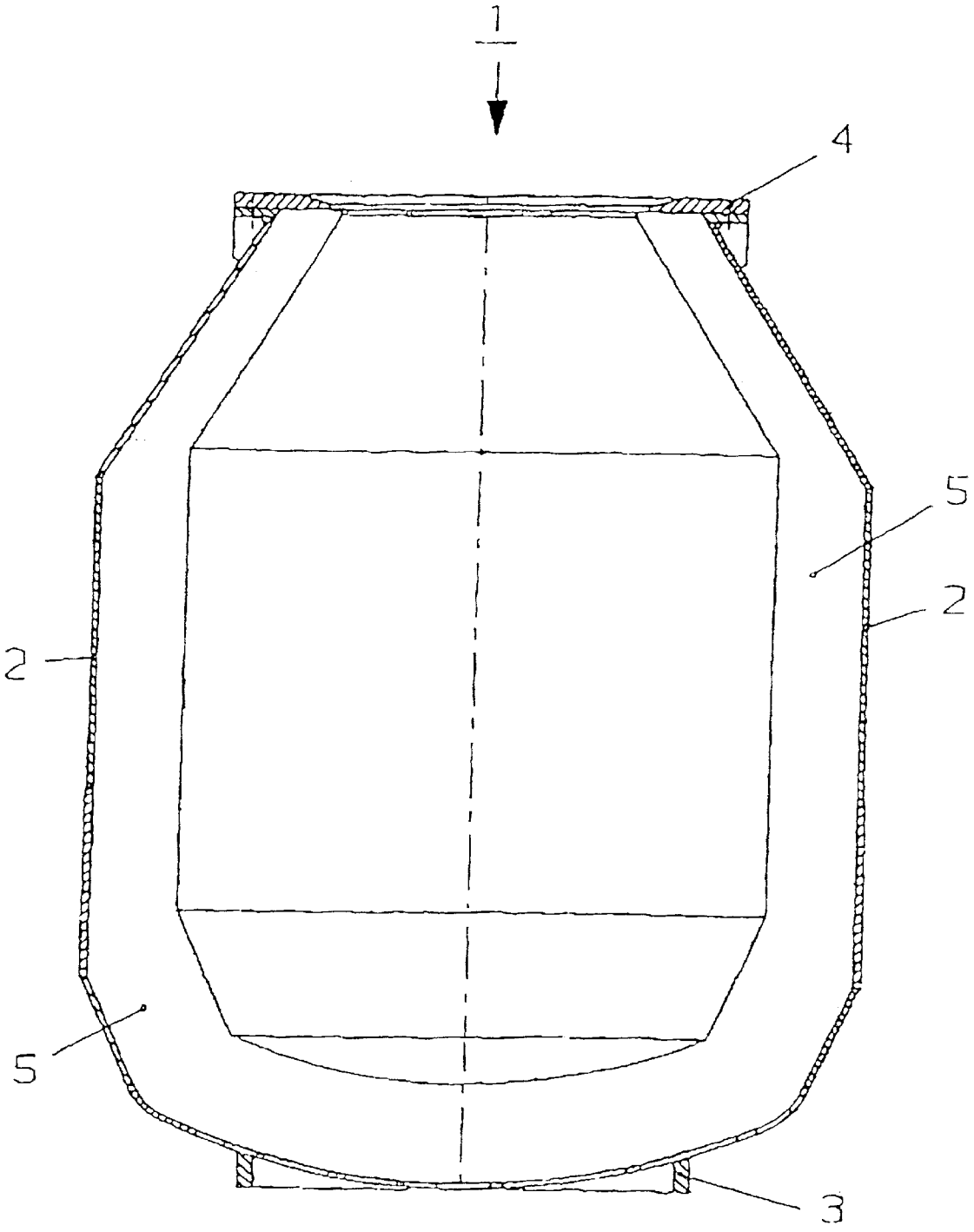
FIG. 1 shows a longitudinal section through a converter produced according to the invention.

FIG. 1 shows a longitudinal section of a converter 1 in accordance with the invention. Converter 1 has a metal shell 2 composed of a plurality of shell rings 6, 7 and dished parts 8, a base ring 3 arranged at the bottom and a lip ring 4 arranged at the upper edge. Arranged within the metal shell 2 is refractory material 5, the thickness of which decreases over the running time of the converter 1 due to the burning off and washing out. The decreasing insulating thickness of the refractory material leads to higher temperatures in the metal shell which must be tolerated over long periods.

Figure 2:
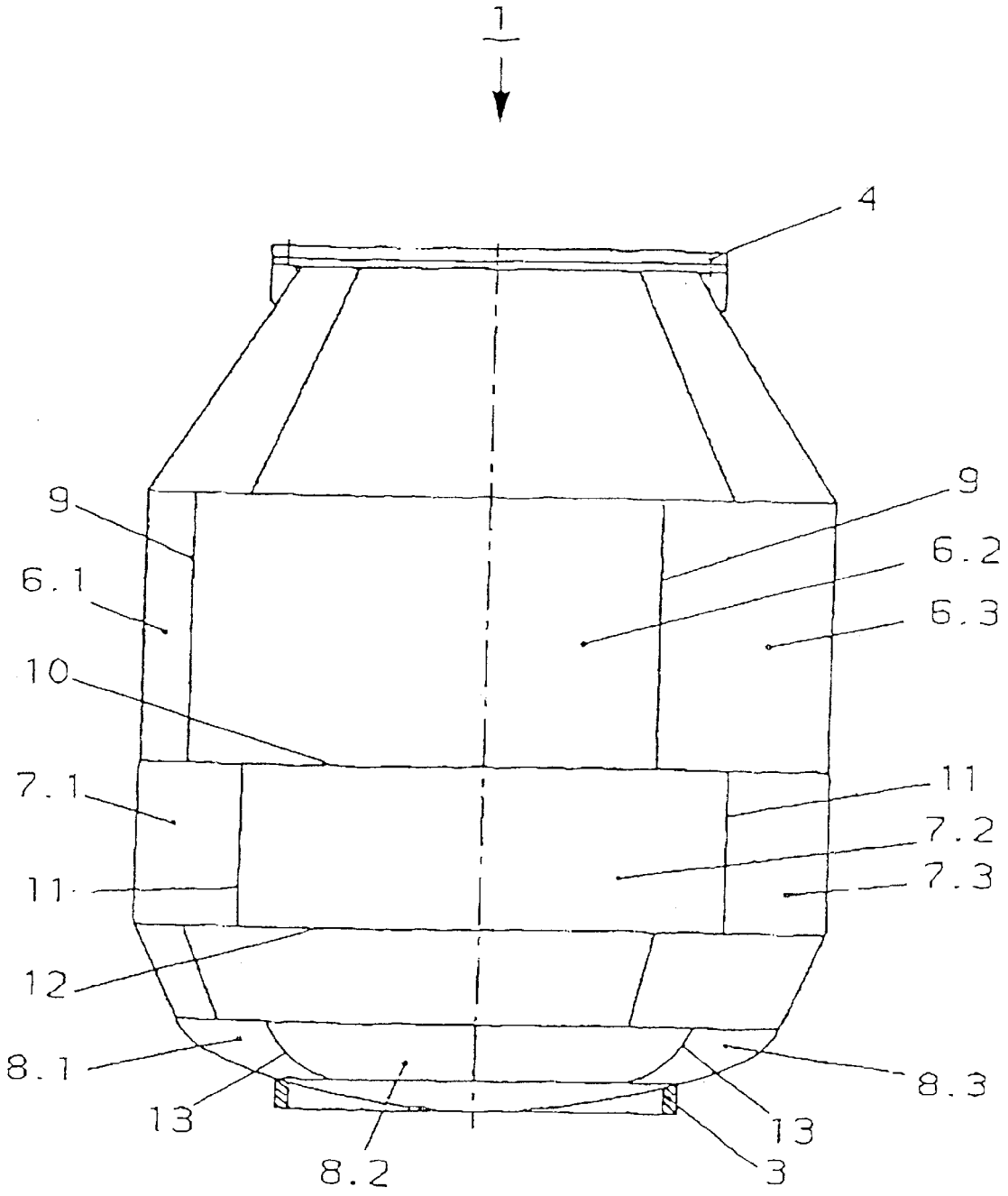
FIG. 2 shows an external view of the vessel of FIG. 1.

FIG. 2 shows an external view of the converter 1 of FIG. 1. FIG. 2 shows the individual shell rings 6.1–6.3, 7.1–7.3 and dished parts 8.1–8.3 with the weld seams 9–13 connecting them. The production process according to the invention, with the main working steps, is explained by taking the example of a shell ring 6.2.

A steel melt is calcium-treated and vacuum-treated before casting and subsequently has the following actual composition in percentages by weight: C 0.17, Cr 0.70, Mo 0.52, Ni 1.90, V 0.093, Mn 0.92, P 0.012, S 0.002, Al 0.020, Si 0.25, Cu 0.13, N 0.009, Ca 0.002, the remainder being iron and impurities due to the production process.

This steel melt is cast by an extrusion process into a slab with a thickness of 260 mm and a width of 2300 mm. After cooling and reheating the slab in a pusher-type furnace to a temperature of approximately 1250° C., a plate with a thickness of 80 mm, a width of 2900 mm and a length of 6000 mm is rolled out from the slab in a number of passes in a hot rolling mill. The individual dimensional change $\epsilon_n$ in the individual passes is in this case greater than 0.1. The heavy plate thus produced is subjected to quenching and tempering, comprising heating up to austenitic temperature of 920° C. and subsequent water quenching. Depending on the requirement for the close-grained structure, this heat treatment may be repeated. The heat treatment is followed by tempering at 700° C. with subsequent cooling in air. After quenching and tempering, the heavy plates are cut to the required dimensions for bending. This is followed by bending into shells at room temperature or, if the rolling pressure is not adequate, with heating to up to 650° C. The bent shells are cut to the desired size and the welded edges are worked. During preassembly, a number of shells are put together, measured and tacked. This is followed by welding into transportable units. At the construction site, the individual shell rings or dished parts are put together and welded together, for example to form a converter. The invention makes it possible to dispense with the stress-relief annealing otherwise required after welding.

The terms and expressions which have been employed are used as terms of description and not of limitation, and there is no intention in the use of such terms and expressions of excluding any equivalent of the features shown and described or portions thereof, it being recognized that various modifications are possible within the scope of the invention.

What is claimed is:

1. A metallurgical vessel comprising a refractory lining; a supporting metal shell surrounding the refractory lining, said metal shell comprising welded together shell rings and dished parts of a creep-resistant steel with plate thickness of up to 100 mm, wherein the creep-resistant steel is a water quenched and tempered close-grained structural steel having the following composition in wt.-%

C 0.14–0.22
Cr 0.4–1.0
Mo 0.3–0.8
Ni 1.5–3.0
V 0.05–0.12
Mn 0.7–1.3
$P_{max}$ 0.015
$S_{max}$ 0.003
Al 0.015–0.065
Si 0.20–0.60
$Cu_{max}$ 0.15
$N_{max}$ 0.012
$Ca_{max}$ 0.004, the remainder being iron and impurities.

2. The metallurgical vessel of claim 1 wherein the creep resistance for 10,000 hours at 500° C. is 220 N/mm$^2$ and at 550° C. is 130 N/mm$^2$.

3. The metallurgical vessel of claim 1 wherein the vessel is a liquid molten metal converter.

4. The metallurgical vessel of claim 3 wherein the liquid molten metal is steel.

5. A process for producing a metallurgical vessel comprising:

a) forming a steel bath by melting a killed steel by the basic oxygen process with a composition comprising on a wt.- % basis C 0.14–0.22
Cr 0.4–1.0
Mo 0.3–0.8
Ni 1.5–3.0
V 0.05–0.12
Mn 0.7–1.3
$P_{max}$ 0.015
$S_{max}$ 0.003
Al 0.015–0.065
Si 0.20–0.60
$CU_{max}$ 0.15
$N_{max}$ 0.012
$Ca_{max}$ 0.004, with the remainder being iron and impurities;

b) casting a slab from the melted killed steel;

c) heating the slab;

d) rolling the slab into heavy plate;

e) quenching and tempering the heavy plate;

f) flame-cutting the plate into parts;

g) bending and/or pressing the parts into shaped parts;

h) welding the shaped parts to form a metal shell;

i) fitting a refractory lining into said shell;

wherein, before casting, the steel is calcium-treated by blowing a calcium alloy into the steel bath and is subsequently vacuum-treated and the hot rolling is carried out with a number of forming passes, which have an individual dimensional change of $\epsilon_n$>0.1, in conjunction with quenching and tempering, thereby dispensing with stress-relief annealing after the welding of the parts produced from the heavy plate.

6. The process of claim 5 wherein the parts are shell rings and dished parts.

7. The process of claim 5 wherein the quenching and tempering comprises water quenching from the austenitic range with subsequent tempering.

8. The process of claim 7 wherein the tempering temperature lies in the range of from 690 to 720° C.

9. The process of claim 5 wherein the quenching and tempering comprises heating up to austenitic temperature, with respective water quenching and subsequent tempering and repeating the heating, water quenching and subsequent tempering.

10. The process of claim 9 wherein the tempering temperature lies in the range of from 690 to 720° C.

* * * * *